US010658781B2

(12) United States Patent
Miyoshi

(10) Patent No.: US 10,658,781 B2
(45) Date of Patent: May 19, 2020

(54) CONNECTOR HAVING A CABLE INCLUDING A PLURALITY OF CORE WIRES

(71) Applicant: HOSIDEN CORPORATION, Osaka (JP)

(72) Inventor: Toshiharu Miyoshi, Osaka (JP)

(73) Assignee: HOSIDEN CORPORATION, Osaka (JP)

( * ) Notice: Subject to any disclaimer, the term of this patent is extended or adjusted under 35 U.S.C. 154(b) by 0 days.

(21) Appl. No.: 16/177,857

(22) Filed: Nov. 1, 2018

(65) Prior Publication Data

US 2019/0140384 A1 May 9, 2019

(30) Foreign Application Priority Data

Nov. 8, 2017 (JP) ..... 2017-215670

(51) Int. Cl.

| | |
|---|---|
| ***H01R 13/405*** | (2006.01) |
| ***H01R 13/506*** | (2006.01) |
| ***H01R 13/52*** | (2006.01) |
| *H01R 13/645* | (2006.01) |
| *H01R 43/24* | (2006.01) |

(52) U.S. Cl.

CPC ..... *H01R 13/405* (2013.01); *H01R 13/506* (2013.01); *H01R 13/5208* (2013.01); *H01R 13/645* (2013.01); *H01R 43/24* (2013.01)

(58) Field of Classification Search

CPC ..... H01R 13/405; H01R 13/506; H01R 13/5208; H01R 13/645; H01R 43/24

USPC ..... 439/656

See application file for complete search history.

(56) References Cited

U.S. PATENT DOCUMENTS

2010/0087100 A1* 4/2010 De Blieck ..... H01R 43/02 439/680

FOREIGN PATENT DOCUMENTS

| | | | |
|---|---|---|---|
| EP | 0460727 | A1 | 12/1991 |
| JP | H09-106853 | A | 4/1997 |
| JP | 2015-076373 | A | 4/2015 |
| JP | 2016-054057 | A | 4/2016 |

(Continued)

OTHER PUBLICATIONS

Office Action issued in European Patent Office (EPO) family member Patent Appl. No. 18203100.5, dated Mar. 13, 2019.

*Primary Examiner* — Abdullah A Riyami
*Assistant Examiner* — Nader J Alhawamdeh
(74) *Attorney, Agent, or Firm* — Greenblum & Bernstein, P.L.C.

(57) ABSTRACT

A connector includes a cable including a plurality of core wires, a plurality of contacts, a body, a body cover housing the body, and an inner mold part. The plurality of contacts are respectively connected to ends, on one side, of the plurality of core wires of the cable. The body includes a plurality of first grooves that have an arc shape on a section orthogonal to an extending direction of the core wires and respectively support the ends, on one side, of the core wires in a contact state. The body cover includes a plurality of lines of rails on an inner side surface thereof, the plurality of lines of rails respectively having second grooves and being extended in parallel with the extending direction of the core wires, the second grooves having an arc shape on the section orthogonal to the extending direction of the core wires.

6 Claims, 5 Drawing Sheets

(56) References Cited

FOREIGN PATENT DOCUMENTS

| | | | | |
|---|---|---|---|---|
| JP | 2016054057 | A | * | 4/2016 |
| JP | 5973977 | B2 | | 7/2016 |

* cited by examiner

CONNECTOR HAVING A CABLE INCLUDING A PLURALITY OF CORE WIRES

TECHNICAL FIELD

The present invention relates to a connector.

BACKGROUND ART

Patent Literature 1 (Japanese Registered Patent No. 5973977, Japanese Patent Application laid Open No. 2015-076373), for example, is a conventional example of a cable connector for connecting a cable and an electronic device.

A cable connector of Patent Literature 1 is a connector capable of effectively reducing possibility that a resin material flows toward a contact portion on a surface of a supported portion of a contact when molding a resin coating portion made of the resin material on connection portions of the contact, an end portion of a cable, a contact support member, and a receiving member.

The cable connector of Patent Literature 1 includes: a contact that includes connection portions, which are positioned on one end side and are to be connected to an end portion of a cable, a contact portion, with which another contact can be brought into contact, and a supported portion disposed between the connection portions and the contact portion; a resin contact support member that includes first support portions for supporting a part of an outer peripheral surface of the supported portion of the contact in a contact manner and a connection portion storing part for storing the connection portions; a resin receiving member that includes receiving holes for receiving the contact support member and the contact and second support portions for supporting the whole excluding a part of the outer peripheral surface of the supported portion in a contact manner so as to support the supported portion with the first support portions; and resin coating portions that are formed so as to be spread over the connection portions, the cable end portion, the connection portion storing part, and the receiving member and cover the connection portions and the cable end portion.

The connector of Patent Literature 1 has a poor following property because the root of the contact is mold-fixed. It is true that the poor following property does not matter if this connector can be manufactured so that no gap is generated with respect to a contact of a mating connector. However, if a gap is generated between a position of the contact of the mating connector and a position of the contact of this connector, the connector may be caught or twisted due to the poor following property.

Further, in order to provide a following property even in a state that a root of a contact is mold-fixed, it is necessary to add another device to the contact such as elongating the contact itself and forming the contact so that the contact easily elastically deforms. Thus, freedom in designing the contact is interfered.

SUMMARY OF THE INVENTION

An object of the present invention is to provide a connector of which a resin material hardly flows toward a contact portion and an appropriate following property can be provided to a contact.

A connector according to the present invention includes a cable including a plurality of core wires, a plurality of contacts, a body, a body cover housing the body, and an inner mold part.

The plurality of contacts are respectively connected to ends, on one side, of the plurality of core wires of the cable. The body includes a plurality of first grooves that have an arc shape on a section orthogonal to an extending direction of the core wires and respectively support the ends, on one side, of the core wires in a contact state. The body cover includes a plurality of lines of rails on an inner side surface thereof, the plurality of lines of rails respectively having second grooves and being extended in parallel with the extending direction of the core wires, the second grooves having an arc shape on the section orthogonal to the extending direction of the core wires, forming circular holes in a manner to be combined with the first grooves, and respectively supporting the ends, on one side, of the core wires in a contact state. The inner mold part is molded so that the inner mold part covers and fixes the holes and the plurality of core wires extending from the holes to the other side.

Effects of the Invention

According to the connector of the present invention, a resin material hardly flows toward a contact portion and an appropriate following property can be provided to a contact.

DETAILED DESCRIPTION OF THE EMBODIMENT

Figure 1:
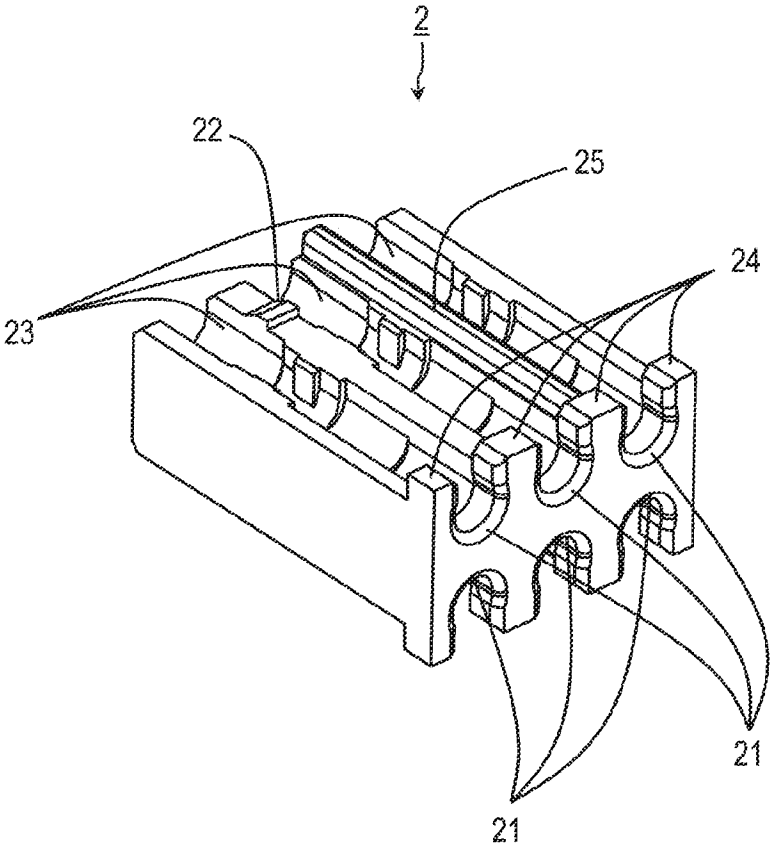
FIG. 1 is a perspective view illustrating a body.

An embodiment of the present invention is detailed below. Components having the same functions are provided with the same reference numerals and duplicate description thereof is omitted.

First Embodiment

A connector according to a first embodiment includes a cable 9 (FIG. 5) including a plurality of core wires 91, a plurality of contacts 1 (FIG. 2), a body 2 (FIG. 1), a body cover 3 (FIG. 3) housing the body 2, an inner mold part 5 (FIG. 5), a shield cover (not shown) covering the body cover 3 and the inner mold part 5, and so on. Each component is described below.

<Body 2>

As illustrated in FIG. 1, the body 2 has a substantially parallelepiped shape and has housing portions 23 for housing the contacts 1, on the upper surface and the lower surface thereof. The housing portion 23 is formed as a groove having a substantially U (substantially semicircular) shape on a section orthogonal to an extending direction of the core wire 91 and the contact 1. Three housing portions 23 are arranged on the upper surface of the body 2 in a direction orthogonal to the extending direction of the core wire 91 and the contact 1 and three housing portions 23 are arranged also on the lower surface of the body 2 in the same manner.

Figure 2:
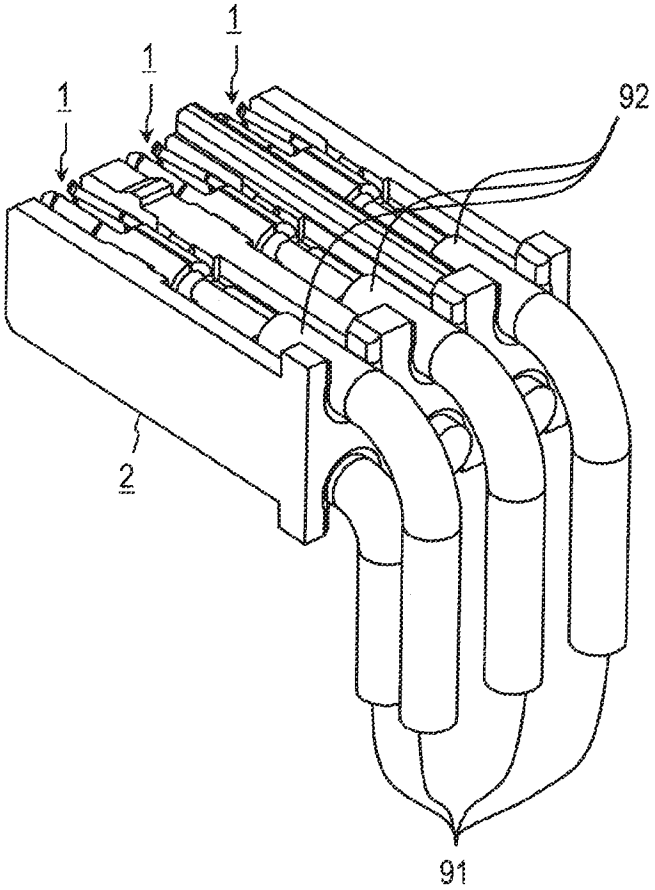
FIG. 2 is a perspective view illustrating a state that contacts and core wires are housed in the body.

When a direction approaching a mating connector is referred to as one side and a direction going away from the mating connector is referred to as the other side, first grooves 21 are formed on respective end portions, on the other side, of the housing portions 23 (see FIG. 2, as well). The first grooves 21 have a substantially semicircular shape (approximate arc shape; a deep groove having a substantially C-shape section on the section in the example of FIG. 1) on the section orthogonal to the extending direction of the core wire 91 and the contact 1 and respectively support ends 92, on one side, of the core wires 91 in a contact state. It is assumed that the first groove 21 does not support the contact 1 but supports only the core wire 91. The first groove 21 may have a semicircular section, but the first groove 21 can more favorably support the core wire 91 when being formed to be a deep groove having the substantially C-shape section as illustrated in FIG. 1. Adjacent to the first grooves 21, convex portions 24 to be fit to concave portions 33, described later, are formed.

On the upper surface and the lower surface of the body 2, first claws 22 which are engaged with second claws 32, described later, to fix the body 2 and the body cover 3 are formed. Each of the first claws 22 is shaped to protrude toward the outside of the body 2 and to be sloped so that the height thereof is increased toward the pulling-out direction of the body 2.

On the upper surface and the lower surface of the body 2, ribs 25 which extend in parallel with the housing direction of the body 2 into the body cover 3 and have a slender convex shape are formed. Each of the pair of upper and lower ribs 25 is formed on an off-center position on the right side, on the figure, from the center in the left and right direction of the body 2. The existence of the ribs 25 does not bring a point-symmetric section of the body 2 and thus can prevent reverse assembly between the body 2 and the body cover 3. The ribs 25 may be formed on any off-center positions other than the positions illustrated in FIG. 1 as long as the ribs 25 do not bring a point-symmetric section of the body 2 on the section orthogonal to the housing direction of the body 2.

<Contact 1>

The contact 1 has a substantially cylindrical shape as illustrated in FIG. 2. In the present embodiment, six contacts 1 are respectively connected to the ends 92, on one side, of six core wires 91 of the cable 9. The connection is performed by pressure bonding, for example. Here, FIG. 2 partially omits illustration of the core wires 91 so as to express only essential points.

<Body Cover 3>

Figure 3:
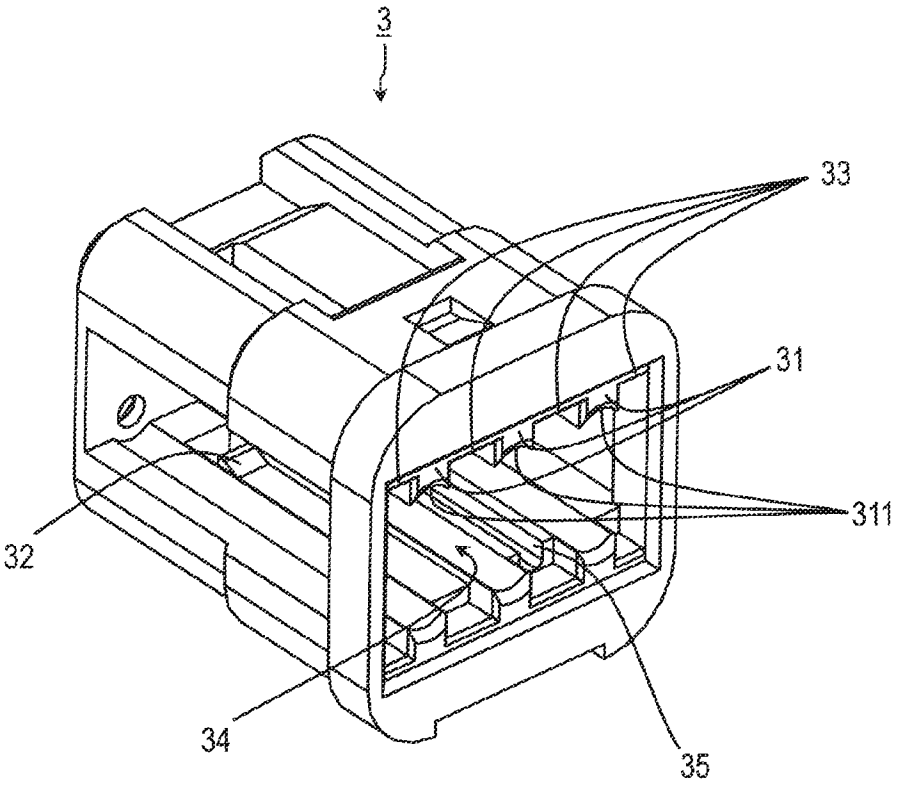
FIG. 3 is a perspective view illustrating a body cover.

The body cover 3 has an approximate casing shape including an opening portion 34 for inserting the body 2, on the surface thereof on the other side (the direction going away from a mating connector), as illustrated in FIG. 3. Three rails 31 are formed on each of upper and lower inner side surfaces of the body cover 3 in a manner to be extended in parallel with the extending direction of the contact 1 and the core wire 91. Second grooves 311 are formed on respective rails 31. The second grooves 311 have a substantially semicircular shape (alternatively, an approximate arc shape; a shallow groove of an arc shape in the example in FIG. 3) on the section orthogonal to the extending direction of the contact 1 and the core wires 91 and form circular holes 41 (see FIG. 4) in a manner to be combined with the first grooves 21 so as to respectively support the ends 92, on one side, of the core wires 91 in the contact state. It is assumed that the second groove 311 does not support the contact 1 but supports only the core wire 91. On the upper side and the lower side of the opening portion 34, the concave portions 33 are formed adjacent to end portions, on the other side, of respective rails 31.

On the upper inner side surface and the lower inner side surface of the body cover 3, the second claws 32 which are engaged with the first claws 22 to fix the body 2 and the body cover 3 are formed. Each of the second claws 32 is shaped to protrude toward the inside of the body cover 3 and to be sloped so that the height thereof is decreased toward the pulling-out direction of the body 2.

The body cover 3 includes key grooves 35, which respectively fit to the ribs 25, on the upper and lower inner side surfaces thereof. The key grooves 35 may be formed on any off-center positions as long as the key grooves 35 do not bring a point-symmetric section of the body cover 3 on the section orthogonal to the housing direction of the body 2. Here, the body cover 3 is an insulator (made of resin).

<Assembly>

Figure 4:
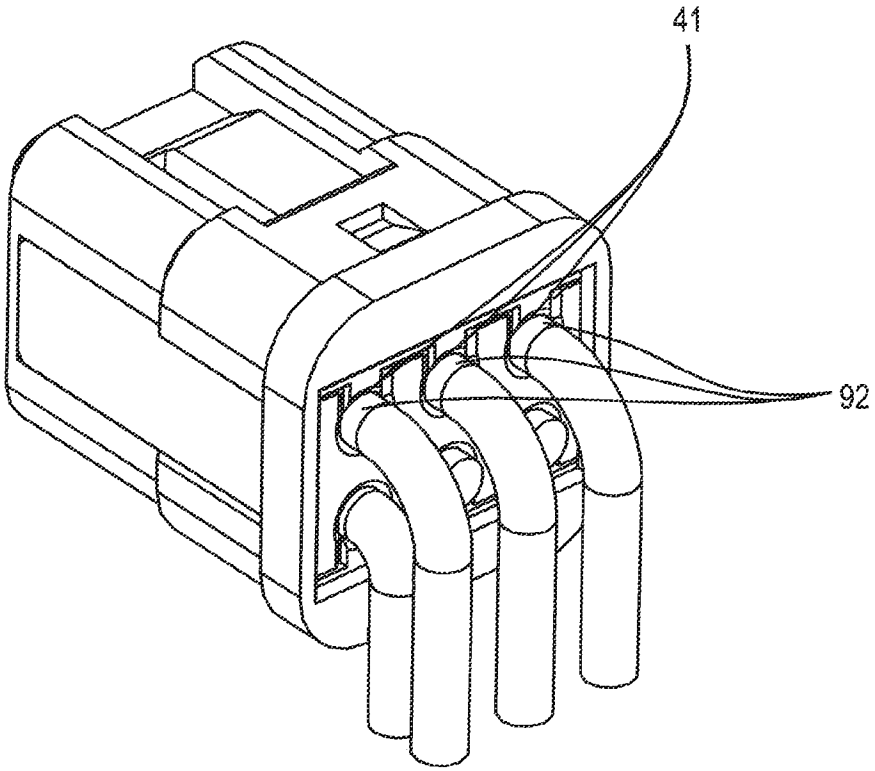
FIG. 4 is a perspective view illustrating a state that the body, the contacts, the core wires, and the body cover are assembled.

As illustrated in FIG. 4, when the body 2 is inserted from the opening portion 34 of the body cover 3 in a state that the contacts 1 and the ends 92 of the core wires 91 are fixed on the body 2, the convex portions 24 and the concave portions 33 are exactly fit to each other. Further, the ends 92 of the core wires 91 are exactly fit in the circular holes 41 which are formed by combining the first grooves 21 and the second grooves 311. It is assumed that the contacts 1 are not fit in the holes 41 and the holes 41 hold only the core wires 91, as described above.

<Inner Mold Part 5>

Figure 5:
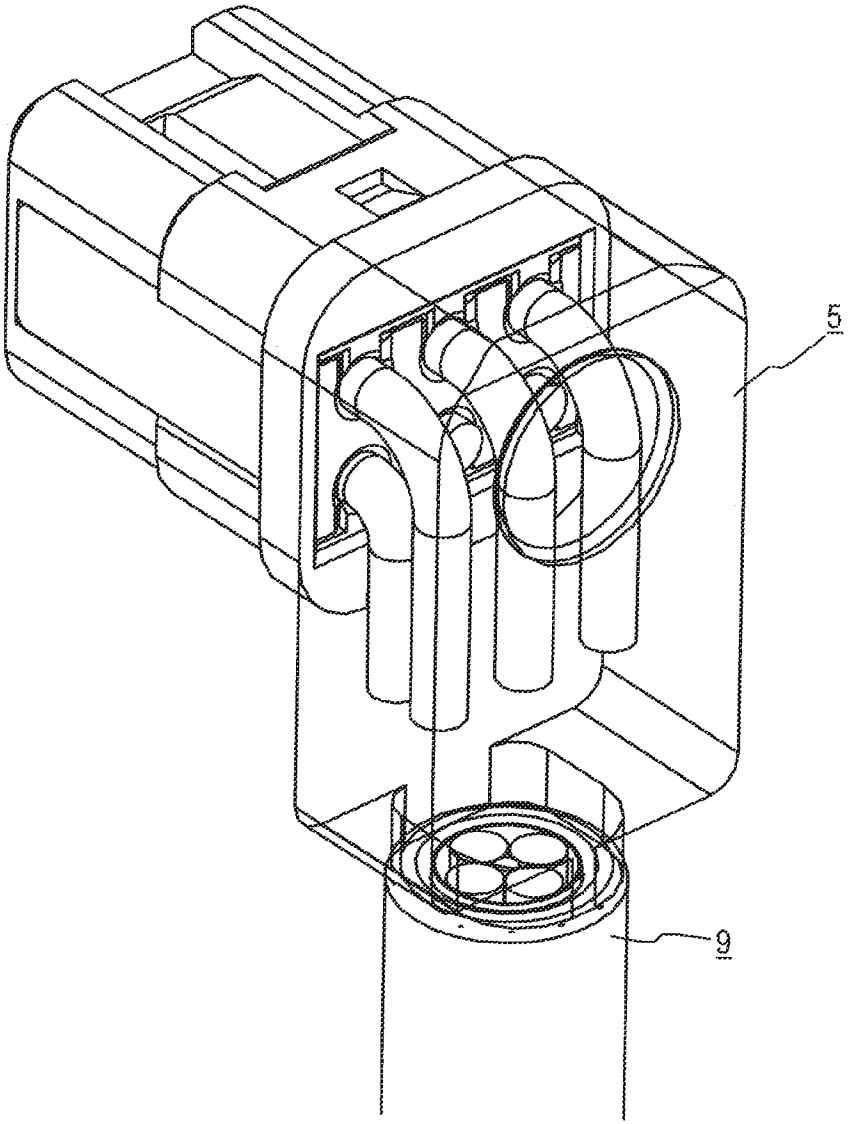
FIG. 5 is a perspective view illustrating a state that an inner mold part is insert-molded in the state of FIG. 4.

The inner mold part 5 is molded so that the inner mold part 5 covers and fixes the holes 41 and a plurality of core wires 91 extending from the holes 41 to the other side (the direction going away from a mating connector), as illustrated in FIG. 5. Here, FIG. 5 illustrates the inner mold part 5 in a transparent manner, that is, illustrates only an outline of the inner mold part 5 so as to show the core wires 91 and the like which are fixed by the inner mold. The inner mold part 5 is an insulator (made of resin, for example). The inner mold part 5 can be formed by insert molding, for example.

Since the connector according to the present embodiment is formed as described above, the body 2 and the body cover 3 are exactly fit to each other and the ends 92 of the core wires 91 are exactly fit in the holes 41 formed by the body 2 and the body cover 3, on the surfaces, on which the inner mold part 5 is formed, of the body 2 and the body cover 3. An outer cover of the core wire 91 is made of soft resin such as polyethylene (PE) and Teflon (a registered trademark) (FEP). Therefore, when the core wire 91 is fit in the hole 41, the outer cover deforms while conforming to the shape of the hole 41 and can nearly eliminate a gap. Thus, a gap to which a resin material flows toward the contact 1 can be nearly eliminated. In addition to this, since not a part of the contact 1 but the end 92 of the core wire 91, to which the contact 1 is connected, is fixed by molding, an appropriate following property can be provided to the contact 1.

When a contact is fit by a body and a body cover without generating any gap, a shape of a hole formed by the body and the body cover needs to be completely matched with a shape of a section of the contact because the contact is made of metal and does not deform. Thus, a disadvantage that adjustment of a dimension and a shape is difficult easily arises conventionally. Further, another disadvantage that electric resistance of the contact is increased easily arises conventionally because a sectional area of the contact needs to be set as small as possible. However, the connector according to the present embodiment can avoid these disadvantages because the contacts 1 are not molded and the ends 92 of the core wires 91 are molded.

In addition to this, the core wires 91 are insert-molded and the core wires 91 can be accordingly protected. Consequently, transmission characteristics (impedance) can be reduced.

The foregoing description of the embodiment of the invention has been presented for the purpose of illustration and description. It is not intended to be exhaustive and to limit the invention to the precise form disclosed. Modifications or variations are possible in light of the above teaching. The embodiment was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A connector comprising:

a cable including a plurality of core wires;

a plurality of contacts;

a body;

a body cover housing the body; and an inner mold cover, wherein the plurality of contacts are respectively connected to ends, on one side, of the plurality of core wires of the cable, the body includes a plurality of first grooves that have an arc shape on a section orthogonal to an extending direction of the core wires and respectively support the ends which are covered by a resin, on the one side, of the core wires in a contact state, the body cover includes a plurality of linear rails on an inner side surface thereof, the plurality of linear rails respectively having second grooves and being extended in parallel with the extending direction of the core wires, the second grooves having an arc shape on the section orthogonal to the extending direction of the core wires, forming circular holes when combined with the first grooves, and respectively supporting the ends which are covered by the resin, on the one side, of the core wires in the contact state, and the inner mold cover is molded so that the inner mold cover covers and fixes the circular holes and only a portion of the plurality of core wires which is covered by the resin and is extending from the circular holes toward another side of the core wires.

2. The connector according to claim 1, wherein the body includes a rib, the rib being extended in parallel with a housing direction of the body, on an off-center position so that a section of the body does not have a point-symmetric shape on a section orthogonal to the housing direction of the body, and the body cover includes a key groove fit to the rib, on the inner side surface thereof.

3. The connector according to claim 1, wherein the body includes a first claw engaged with a second claw, the second claw being provided on the body cover, and the body cover includes the second claw on the inner side surface thereof.

4. The connector according to claim 2, wherein the body includes a first claw engaged with a second claw, the second claw being provided on the body cover, and the body cover includes the second claw on the inner side surface thereof.

5. The connector according to claim 1, wherein the resin is a soft resin.

6. The connector according to claim 5, wherein the soft resin is one of polyethylene and fluorinated ethylene propylene.

* * * * *